US011197512B2

(12) United States Patent
Twombly

(10) Patent No.: US 11,197,512 B2
(45) Date of Patent: Dec. 14, 2021

(54) DETACHABLE, RETRO FITTING LIGHT ACCESSORY FOR HIGH-HEELED SHOES

(71) Applicant: Michael Andrew Twombly, Cincinnati, OH (US)

(72) Inventor: Michael Andrew Twombly, Cincinnati, OH (US)

( * ) Notice: Subject to any disclaimer, the term of this patent is extended or adjusted under 35 U.S.C. 154(b) by 0 days.

(21) Appl. No.: 17/215,788

(22) Filed: Mar. 29, 2021

(65) Prior Publication Data

US 2021/0298406 A1 Sep. 30, 2021

Related U.S. Application Data

(60) Provisional application No. 63/000,903, filed on Mar. 27, 2020.

(51) Int. Cl.
*A43B 3/00* (2006.01)
*F21S 9/02* (2006.01)
(Continued)

(52) U.S. Cl.
CPC ..... *A43B 3/001* (2013.01); *F21S 9/02* (2013.01); *F21V 21/0808* (2013.01);
(Continued)

(58) Field of Classification Search
CPC .. F21V 21/096; F21V 21/0808; F21V 23/003; F21V 23/001; F21V 33/0008; A43B 3/001; F21S 9/02; F21Y 2115/10
See application file for complete search history.

(56) References Cited

U.S. PATENT DOCUMENTS 1,693,398 A 11/1928 Miller et al.
2,370,789 A 3/1945 Glagovsky
(Continued)

FOREIGN PATENT DOCUMENTS

DE 202014000504 U1 6/2014
EP 2404972 1/2012
(Continued)

OTHER PUBLICATIONS

FlashingBlinkyLights.com, Inc., Sep. 27, 2002, obtained from the Wayback Machine, https://web.archive.org/web/20020927040159/http://www.flashingblinkylights.com/ (1 page).
(Continued)

*Primary Examiner* — Peggy A Neils
(74) *Attorney, Agent, or Firm* — Daniel F. Nesbitt; Hasse & Nesbitt LLC

(57) ABSTRACT

A detachable, retrofitting light accessory for both magnetic and adhesive attachment to a high-heeled shoe having an open archway with a ferrous metal shank, having a light-emitting diode (LED) light assembly, a magnet affixed to the LED light assembly and configured to magnetically engage the ferrous metal shank in the open archway of the shoe, and to magnetically attach the light accessory to the shoe, and a double-sided adhesive strip configured for placement between the magnet and an outer surface in the open archway to also adhesively attach the light accessory to the shoe, to prevent the light accessory from slipping relative to the shoe during use.

20 Claims, 4 Drawing Sheets

(51) Int. Cl.

| | |
|---|---|
| ***F21V 21/096*** | (2006.01) |
| ***F21V 23/00*** | (2015.01) |
| ***F21V 21/08*** | (2006.01) |
| ***F21Y 115/10*** | (2016.01) |

(52) U.S. Cl.
CPC ..... *F21V 21/096* (2013.01); *F21V 23/001* (2013.01); *F21V 23/003* (2013.01); *F21Y 2115/10* (2016.08)

(56) References Cited

U.S. PATENT DOCUMENTS

| | | | |
|---|---|---|---|
| 2,465,817 | A | 3/1949 | Perugia |
| 2,632,093 | A | 3/1953 | De Merolis et al. |
| 3,800,133 | A | 3/1974 | Duval |
| 3,893,247 | A | 7/1975 | Dana, III |
| 4,158,922 | A | 6/1979 | Dana, III |
| 4,253,253 | A | 3/1981 | McCormick |
| 4,848,009 | A | 7/1989 | Rodgers |
| 5,188,447 | A | 2/1993 | Chiang et al. |
| 5,408,764 | A | 4/1995 | Wut |
| 5,456,032 | A | 10/1995 | Matsumoto et al. |
| 5,473,518 | A | 12/1995 | Haber et al. |
| 5,516,581 | A | 5/1996 | Kreckel et al. |
| 5,894,686 | A | 4/1999 | Parker et al. |
| 6,033,762 | A | 3/2000 | Decker |
| 6,410,135 | B1 | 6/2002 | Hamerski et al. |
| 6,541,089 | B1 | 4/2003 | Hamerski et al. |
| 6,616,790 | B2 | 9/2003 | Luhmann et al. |
| 6,789,913 | B2 | 9/2004 | Wei |
| 7,028,958 | B2 | 4/2006 | Pitzen et al. |
| 7,101,615 | B2 | 9/2006 | Luhmann et al. |
| 7,204,045 | B2 | 4/2007 | Lee |
| 7,550,935 | B2 * | 6/2009 | Lys ..... A43B 3/0021 315/318 |
| 8,469,535 | B2 | 6/2013 | Guzman |
| 8,557,378 | B2 | 10/2013 | Yamanaka et al. |
| 9,943,137 | B2 * | 4/2018 | Leo ..... A43B 23/24 |
| 2006/0007668 | A1 | 1/2006 | Chien |
| 2006/0174521 | A1 | 8/2006 | Lee |
| 2019/0082756 | A1 | 3/2019 | Arno |
| 2020/0107612 | A1 | 4/2020 | Schickling |
| 2021/0071859 | A1 * | 3/2021 | Ansell ..... F21V 23/06 |

FOREIGN PATENT DOCUMENTS

| | | |
|---|---|---|
| JP | H0594715 A | 4/1993 |
| WO | 2020086294 | 4/2020 |

OTHER PUBLICATIONS

K&J Magnetics, Inc., May 1, 2003, obtained from the Wayback Machine, https://web.archive.org/web/20030501182002/https://www.kjmagnetics.com/ (1 page).

"Command™ Poster Strips Value Pack, White, 12 Strips (17024ES)", Quill.com, first review of product posted Jul. 27, 2010, https://www.quill.com/command-poster-strips-value-pack-white-12-strips-17024es/cbs/241017.html (4 pages).

International Search Report and Written Opinion by the USPTO (as International Searching Authority), dated Aug. 4, 2021, for related International Application No. PCT/US2021/024633 filed Mar. 29, 2021 (16 pages).

* cited by examiner

DETACHABLE, RETRO FITTING LIGHT ACCESSORY FOR HIGH-HEELED SHOES

CROSS-REFERENCE TO RELATED APPLICATION

This application claims the benefit of U.S. Provisional Application No. 63/000,903 filed Mar. 27, 2020, the disclosure of which is hereby incorporated by reference in its entirety.

FIELD OF THE INVENTION

The present disclosure is related to footwear and, more particularly to lighting for footwear.

BACKGROUND OF THE INVENTION

Many lighting devices for shoes are known. However, there are various problems associated with these devices ranging from size, shape, attachment, decorative enclosures, the necessity for translucent soles or heels, and even more so, many of these devices are housed in or incorporated into the shoes themselves, in cavities of the shoes, for example. Thus, these latter devices rely on the designs of the shoes themselves for the inclusion or housing of lighting devices.

U.S. Pat. No. 2,632,093 teaches an illuminated ornament, for example, a bow or buckle, a rosette, a flower, or an insert, an animal, or a vegetable, that is worn on an article of clothing. More specifically, the patent shows an illuminated bow for a shoe attached using a clamp or clip. In the depicted example, the illuminated bow includes an incandescent lamp, a battery and various structural elements that form a momentary switch, all of which are arranged in an electric circuit. As a person wearing the shoe walks, the deformation of the shoe actuates the switch so that the switch opens and closes alternately in response to the person walking thereby lighting and extinguishing the lamp. In the alternative, a switch can be manually actuated to light the lamp continuously.

U.S. Pat. No. 4,848,009 teaches shoes having built-in or integrated lighting and is hereby incorporated by reference in its entirety. A lighting circuit includes a number of light-emitting diodes (LEDs), a battery, an activation switch, in the form of mercury or piezoelectric switch, and a monostable multi-vibrator. In use, movement of the shoe actuates the activation switch to cause the monostable multi-vibrator to light the LEDs for a predetermined interval. The activation switch must then be reactivated, i.e., turned on and off, for the multi-vibrator to relight the LEDs. This circuit arrangement prevents the LEDs from remaining lit and draining the battery irrespective of the position that the shoe is left in.

U.S. Pat. No. 5,408,764 teaches the use of a mechanical, pendulum-type switch to provide motion activation of LED lighting that is integrated into the heel of a shoe and thereby distinguishes over U.S. Pat. Nos. 3,800,133, 4,253,253, and 5,188,447, all of which use a pressure sensitive switch, and all of which are hereby incorporated by reference in their entireties, and U.S. Pat. Nos. 3,893,247, 4,158,922, and 4,484,009 that use a mercury-tilt switch, all of which are also hereby incorporated by reference in their entireties.

U.S. Pat. No. 5,456,032 teaches the use of a mechanical acceleration-sensitive make-and-break switch with LEDs in a decoratively shaped casing that can be attached to a shoe and is hereby incorporated by reference in its entirety. Specifically, the casing is "adhered" to the shoe using a doubled faced adhesive tape. In addition, an adhering adapter can be used to tie the device to the shoe or elsewhere on the body of the user.

U.S. Pat. No. 5,473,518 teaches a flashing LED light housing that is removably attached to the heel of a shoe. The attachment is made by a hook affixed to the housing, by hooking the hook over the upper portion of the heel of the shoe and/or with a resilient attachment band that is also attached to the housing and attaches to the sole of the shoe using screw-like fasteners. A button engages an on-off switch through a mechanical mechanism, but the flashing light circuit is said to be conventional in nature and no description is given. The LEDs are started to flash continuously and not in response to movement.

U.S. Pat. No. 5,894,686 teaches a lighting system, for example, a battery powered LED lighting system that can be energized by connecting/disconnecting a power source, e.g., a coin-type battery, or by using an on-off, pressure, dome, membrane, mercury or reed switch, a timer circuit, a motion sensor, a microprocessor or an integrated circuit, or the like, that can be incorporated into an article of clothing, such as a shoe. The system can be attached by sewing, gluing, or removably attaching, e.g., hook and loop fastener, to the upper portion of the shoe, placed in a pocket of the shoe, or on an upper backside of the shoe. Alternatively, in the case of the use of a pressure switch, the lighting system can be integrated into the sole of the shoe, along the ball of the foot or heel of the portion of the sole, i.e., a flashing light in response to a footfall.

U.S. Pat. No. 6,789,913 teaches a multifunction shoe flashing device that is installed in the heel of a shoe, although other parts of the shoe are mentioned for mounting, and takes advantage of the advent of the multicolored LED, e.g., red, green, and blue, rather than discrete LEDs, one for each color. The selection of different flash rates for each color and combinations of colors are described in some detail.

U.S. Pat. No. 7,204,045 teaches a shoe with light emitting elements, i.e., a battery, a switch, a LED or electroluminescent plate or a sheet that contains a phosphor layer that illuminates when a voltage is applied, and a lens. The light emitting elements are integrated into the heel, sole, or upper body of the shoe. The lighting can be continuous, a simple DC circuit, using the aforementioned electronic components or flashing, using a control circuit, although no description of the control circuit is provided.

U.S. Pat. No. 8,469,535 teaches an article of footwear that includes an outsole and an upper mounted to the outsole, and an electronic circuit built into the outsole or upper. The electronic circuit includes a power source, e.g., a battery, a loudspeaker, an array of light sources, e.g., LEDs, a controller, e.g., an integrated circuit, a motion responsive switch, and a manually operated switch. The manual switch functions as an on-off switch while the motion switch causes an integrated circuit to flash the LEDs in a particular pattern and to generate accompanying sounds that are broadcast by the loudspeaker.

US Patent Application Publication US2006/0007668 teaches "dice- or chip-type" LEDs, likely surface mount (SMD or SMT) LEDs, in various locations on a sandal with wiring leading to batteries located in the heel of the sandal.

US Patent Application Publication US2019/0082756 teaches a radio frequency accessible illuminated placard including red, green, and blue LEDs capable of displaying a variety of logos, images, and text that is adhesively attached, e.g., "high-tack" adhesive, to a desired surface of a shoe, for example, a side panel, a toe front covering, or a heel portion.

US Patent Application Publication US2020/0086294 teaches a high heeled show with an arch support having plural magnets that magnetically couple with magnets embedded in the insole on the inside insole of the shoe.

Despite these numerous and various lighting solutions for shoes, no one solution for a detachable, retrofitting, light accessory for high-heeled shoes exists that takes advantage of the materials and construction methods used in these shoes. Accordingly, those skilled in the art continue with research and development efforts in lighting accessories for shoes.

SUMMARY OF THE INVENTION

The present invention provides a detachable light accessory configured for attachment to a high-heeled shoe having an open archway, and a ferrous metal shank in at least one of the sole and the heel of the shoe. The light accessory comprises a light emitting diode (LED) light assembly, a magnet, and a double-sided adhesive strip. The LED light assembly includes an enclosure having an attachment end and a light-emitting end having an aperture, at least one light emitting diode (LED) housed within the enclosure and configured to emit a light through the light-emitting end of the enclosure, and at least one battery housed within the enclosure, for providing electrical power to the at least one LED. The magnet is affixed to the attachment end of the LED light assembly and is configured to magnetically engage the ferrous metal shank in the archway of the shoe. The double-sided adhesive strip includes a first adhesive side and a second adhesive side, and is configured for placement between the magnet and an outer surface in the open archway of the shoe, to attach the first adhesive side adhesively and detachably to the magnet, and the second adhesive side to the outer surface in the open archway of the shoe, thereby magnetically and adhesively attaching the detachable light accessory in the open archway of the shoe.

The detachable light accessory can be retrofitted onto the outer surface of a sole or heel of a separate, existing high-heeled shoe within the open archway. The magnetic attraction of the magnet to the ferrous metal shank is distinct and separate from the adhesive attachment of the LED light assembly to the outer surface of the sole of the shoe. The magnetic attraction and the adhesive attachment work together to provide a secure affixment of the light accessory to the shoe. Removal of the light accessory is made easier by first breaking the magnetic attraction by manually twisting or tilting the light assembly away from the double-sided adhesive strip, and then by removing the double-sided adhesive strip from the outer surface of the sole of the shoe.

In various embodiments, the LED light assembly further comprises a means for connecting electrically the at least one LED selectively to the at least one battery, to power the at least one LED.

In various embodiments, and useful in combination with any one or more embodiments, the means for connecting electrically is selected from the group consisting of a switch integrated into the enclosure that electrically couples the at least one LED and the at least one battery, and an insulating sheet, strip or film that can be placed between two components selected from among the means for connecting electrically, the at least one LED, and a combination thereof.

In various embodiments, and useful in combination with any one or more embodiments, the switch can be configured for switch-selectable continuous or intermittent lighting.

In various embodiments, and useful in combination with any one or more embodiments, the light accessory attaches to the heel of the shoe, or to the outer surface of the sole of the shoe.

In various embodiments of the invention, and useful in combination with any one or more embodiments, the light accessory further comprises a ferrous metal insert configured for insertion into the shoe along the shoe sole, in the event that the shoe does not have a ferrous metal shank, the magnet engaging the ferrous metal insert to magnetically attach the light accessory to the shoe.

In various embodiments of the invention, and useful in combination with any one or more embodiments, the enclosure having a right cylindrical construction, a longitudinal axis of the cylinder extending substantially perpendicular to the surface of the archway when the light accessory is magnetically and adhesively attached to the shoe.

In various embodiments of the invention, and useful in combination with any one or more embodiments, the attachment end of the enclosure comprises a cylindrically-shaped pylon having a longitudinal axis, the attachment end of the enclosure comprising an angled face forming an oblique angle with the longitudinal axis.

In various embodiments of the invention, and useful in combination with any one or more embodiments, the oblique angle is selected so that the longitudinal axis of the pylon is vertically oriented in the archway of the shoe when the light accessory is attached to the sole of the shoe.

In various embodiments of the invention, and useful in combination with any one or more aspects and embodiments, the enclosure including a metal conductor for forming an electrical circuit including the at least one battery and the at least one LED.

In various embodiments of the invention, and useful in combination with any one or more embodiments, the LED light assembly further includes an electronic circuit electrically coupled to the at least one battery and the at least one LED, the electronic circuit configured to control the application of battery power to the at least one LED, wherein the control includes at least one of on/off, flash, rate of application, variable intensity, variable brightness, and change in color functionalities.

In various embodiments of the invention, and useful in combination with any one or more embodiments, the LED light assembly further including a lens positioned across the aperture and configured to pass light from the at least one LED.

In various embodiments of the invention, and useful in combination with any one or more embodiments, the lens including a pattern, the pattern causing light dispersed from the at least one LED to be in the form of at least one of text, a symbol, and a logo.

In various embodiments of the invention, and useful in combination with any one or more embodiments, the LED emits light that is at least one of clear, white, red, green, blue, RGB (a discrete combination of red, green, and blue), rainbow (a variable combination of red, green, and blue), pink, ultraviolet, bi-color, tri-color, and multicolor.

In various embodiments of the invention, and useful in combination with any one or more embodiments, the at least one battery is a coin-shaped battery having a shape of a circular cylinder with a thickness that is less than the diameter of the cylinder.

In various embodiments of the invention, and useful in combination with any one or more embodiments, the switch is a type select from the group consisting of a and rotating-, screw-, threaded-, button-, push button-, and single pole-single throw switches.

In various embodiments of the, and useful in combination with any one or more embodiments, the magnet is a neodymium magnet.

In various embodiments of the invention, and useful in combination with any one or more embodiments, the magnet is one or more disk-shaped neodymium magnet that is axially magnetized, the magnet having a diameter of about 5 millimeters (mm) to about 15 mm, an axial thickness of about 2 mm to about 6 mm, and a pull force of about 3 kilograms-7 kg. In one preferred embodiment, the neodymium magnet has a diameter of about 12.7 mm, a thickness of about 3.175-5.080 mm, and a pull force of about 3.62-5.13 kg. The pull force is the holding force of a magnet that is in contact with a flat steel plate. A magnet may also have a maximum magnetic energy product of about 42 to about 52 mega gauss oersteds (MGOe).

In another embodiment, an adhesive strip can include a metal component, e.g., a ferrous metal disk sized to the magnet, that is adhered to the surface of the archway. The magnet can then engage the metal component for magnetic attachment of the light accessory. This alternative embodiment alleviates the need for the metal shank and/or the metal insert. A detachable light accessory configured for attachment to a high-heeled shoe that has an open archway, the detachable light accessory comprising: a light emitting diode (LED) light assembly including: i) an enclosure having an attachment end and a light-emitting end having an aperture; ii) at least one light emitting diode (LED) housed within the enclosure and configured to emit a light through the light-emitting end of the enclosure: and iii) at least one battery housed within the enclosure, for providing electrical power to the at least one LED; a magnet affixed to the attachment end of the LED light assembly and configured to magnetically engage the ferrous metal shank in the archway of the shoe; and a double-sided adhesive strip including an integrated ferrous metal disk, a first adhesive side and a second adhesive side, and is configured for placement between the magnet and an outer surface in the open archway of the shoe, to attach the first adhesive side adhesively and detachably to the magnet, and the second adhesive side to the outer surface in the open archway of the shoe, thereby magnetically and adhesively attaching the detachable light accessory in the open archway of the shoe.

The present invention also provides a method of adding decorative lighting into an open archway of a high-heeled shoe. According to the present invention, the method of adding decorative lighting includes providing the light accessory described herein, including the steps of mechanically coupling a magnet to a light-emitting diode (LED) light assembly to form a light accessory. A double-sided adhesive strip is provided having a protective film on both sides, having a size at least the size of the magnet. The method also includes passing the magnet affixed to the LED light assembly over a surface of a sole or a heel in the open archway of a high-heeled shoe, to determine a location of magnetic attraction to a ferrous metal shank in the open archway of the shoe, and noting the location of magnetic attraction of the magnet to the ferrous metal shank. The method also includes the steps of removing a protective film from the first adhesive side of the double-sided adhesive strip and applying and adhesively attaching the first adhesive side of the double-sided adhesive strip to the magnet, and removing a protective film from the second side of the double-sided adhesive strip and positioning the second side of the double-sided adhesive strip proximate the location of magnetic attraction, and pressing and adhesively attaching the second side of the double-sided adhesive strip against the outer surface of the sole or the heel at the location of magnetic attraction, thereby both adhesively and magnetically attaching the light accessory to the shoe. Once the light accessory is affixed to the shoe, the method includes the step of energizing the light accessory. Optionally, the light accessory can be removed.

In an alternative embodiment of the method, the step of passing the magnet can comprise determining that the sole or heel in the open archway of the shoe does not have a ferrous metal shank, inserting a ferrous metal insert into the shoe proximate a desired location in the archway for the light accessory. The magnet affixed to the LED light assembly is then passed again over a surface of a sole or a heel in the open archway of a high-heeled shoe, to determine a location of magnetic attraction to the ferrous metal insert in the open archway of the shoe.

In various embodiments of the invention, and useful in combination with any one or more embodiments, wherein energizing the light accessory comprises at least one of removing an insulating strip and actuating a switch.

In various embodiments of the invention, and useful in combination with any one or more embodiments, the method further includes a step of cleaning the outer surface of the sole in the archway of the shoe to remove dirt prior to positioning the light accessory against the outer surface.

In various embodiments of the invention, and useful in combination with any one or more embodiments, the method further comprises a step of removing the light accessory, and a step of removing any adhesive from the archway after removing the light accessory. Once the light accessory has been removed from the shoe, it is not possible to tell that the light accessory had been attached to the shoe.

In various embodiments of the invention, and useful in combination with any one or more embodiments, the method further includes a step of removing the light accessory from the shoe and replacing at least one battery in the light accessory.

BRIEF DESCRIPTION OF THE DRAWINGS

Various embodiments of a detachable, retrofitting light accessory configured for attachment into an open archway of a high-heeled shoe will become better understood with regards to the following description, appended claims and accompanying drawings wherein:

DETAILED DESCRIPTION OF THE INVENTION

The present invention can include elements and features that can be found in U.S. Pat. Nos. 1,693,398, 2,370,789, 2,465,817, 2,632,093, 3,800,133, 3,893,247, 4,158,922, 4,253,253, 4,848,009, 5,188,447, 5,408,764, 5,456,032, 5,473,518, 5,516,581, 5,894,686, 6,033,762, 6,410,135, 6,541,089, 6,789,913, 7,028,958, 7,101,615, 7,204,045, 8,469,535, and 8,557,37, US Patent Application Publications US2006/0007668 and US2019/0082756, and European Patent Publication EP 2,404,972, each of which are hereby incorporated by reference in their entireties.

Figure 1:
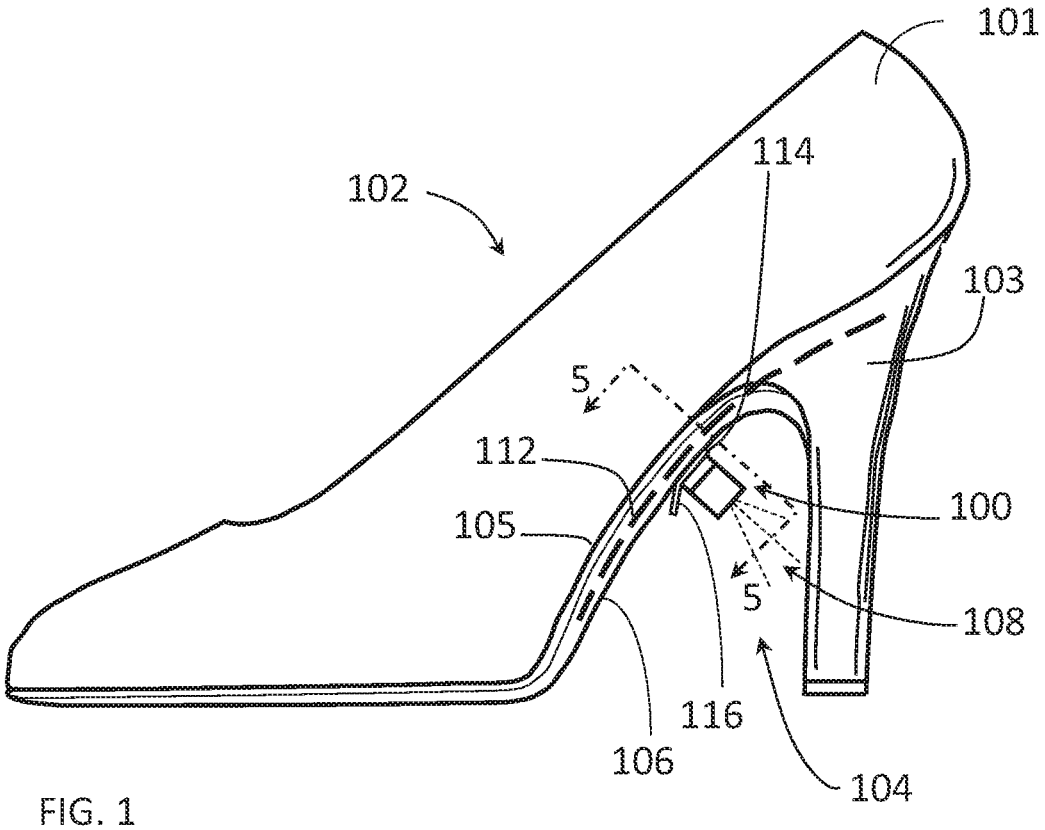
FIG. 1 is a profile view of a first embodiment of a detachable, retrofitting light accessory affixed to a sole of a high-heeled shoe.

FIG. 1 is a profile view of a detachable, retrofitting light accessory 100 in accordance with a first embodiment of the present invention. As depicted, the light accessory 100 has been affixed to a high-heeled shoe 102 having a shoe upper 101, and having an open archway 104 and, more specifically, to an outside surface 106 of the sole 105 that forms the open archway, thereby adding lighting functionality to the shoe and/or retrofitting the shoe with lighting or illumination, as generally indicated at reference numeral 108. Those of skill in the art will appreciate that the high-heeled shoe 102 is conventional in nature and has not been designed and manufactured to include lighting or modified in any way to allow for lighting. For example, U.S. Pat. Nos. 1,693,398, 2,370,789, and 2,465,817 all teach the construction of a high-heeled shoe. Those of skill in the art will understand that lighting 108 is useful, and also appreciate that the lighting 108 can be decorative or ornamental in nature, and desirous for purposes of entertainment or setting a wearer of the shoes apart while dancing and/or celebrating a "night on the town," for instance.

Figure 6:
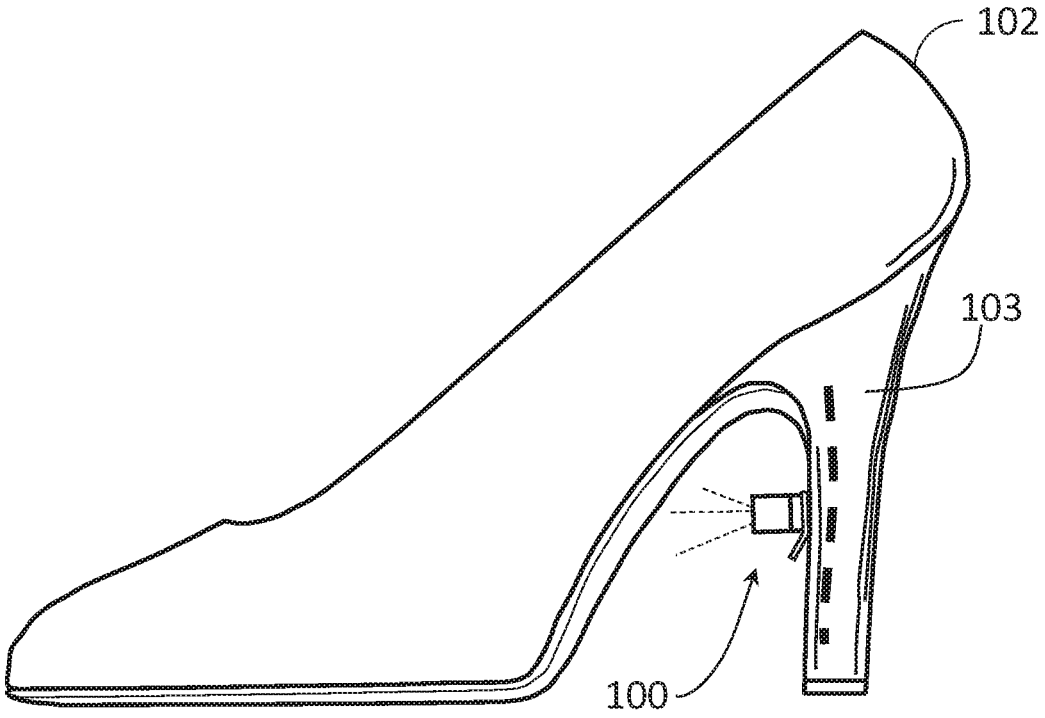
FIG. 6 is a profile view of an alternative embodiment of the detachable, retrofitting light accessory attached to the heel of the high-heeled shoe.

In accordance with an embodiment of the present invention, the light accessory 100 is both magnetically and adhesively affixed or attached to the sole 105 (FIG. 1) or to the heel 103 (FIG. 6) of the shoe. In an embodiment, the light accessory 100 includes a magnet 110, see FIG. 2, for example, for magnetic attachment. In an embodiment, the magnet is preferably a permanent, neodymium-type, selected for magnetic strength. As shown in FIG. 1, the magnet 110 is attracted to and is magnetically engaged with a ferrous metal shank 112 that has been incorporated and built into the sole 105 of the high-heeled shoe 102, and that supports and defines the open archway 104 of the shoe. The ferrous metal shank 112 is hidden within and built into the shoe, as shown in dashed line in FIG. 1 for purposes of illustration. In some embodiments, the shoe as originally manufactured can have a ferrous metal shank built into the sole or the heel, or both. In other embodiments of a high-heeled shoe, the heel 103 can include a ferrous metal shank for structural support. Thus, in an embodiment, the present invention takes advantage of the inherent construction of those pre-existing, high-heeled shoes that include or have a ferrous metal shank 108 in either the sole or heel for purposes of magnetic attachment.

The light accessory 100 also includes a doubled-sided adhesive strip 114 for providing an adhesive attachment of the lighting accessory 100 to the shoe 102. In an embodiment, the doubled-sided adhesive strip 114 can be a foam sheet or other substrate layer with an adhesive film applied to both sides or faces of the foam sheet, over each of which a protective plastic film layer or paper layer has been applied, as is commonly available. In various embodiments, the doubled-sided adhesive strip is configured for temporarily and removably attaching the light accessory to the outer (under) surface 106 of the sole 105, or the heel 103, of the shoe. Non-limiting examples of doubled-sided adhesive strips that provide temporary and removable attachment to surfaces are described in U.S. Pat. Nos. 5,516,581, 6,033,762, 6,410,135, 6,541,089, 7,028,958, 7,101,615, 8,557,37, and EP 2,404,972, the disclosures of which are incorporated by reference in their entireties. Non-limiting examples of such products are available from 3M Innovation Properties Company under the Command™ brand name.

Those of skill in the art will appreciate that while magnetic attraction and interaction between the magnet 110 and the ferrous metal shank 112 functions to hold or attach the lighting accessory 100 to the shoe 102, the adhesive attachment functions to prevent the lighting accessory 100 from slipping relative to the outer surface 106 of the open archway 106 of the high-heeled shoe 102 during use or, more particularly, during rapid or sudden movements by a wearer, and allows the lighting accessory 100 to survive or endure the repetitive, jarring impacts of footfalls associated with walking, running, stomping, dancing, etc.

The present invention also allows for detachment or removal of a light accessory from the sole or heel of the shoe. In an embodiment, the adhesive affixment of the magnet 110 and the attachment end of the lighting assembly 100 can be dislodged and separated from the sole 105 of the shoe. Further, the adhesive strip 114 includes a pull tab 116 for purposes of stretching the adhesive strip 114 and removing the light accessory 100 from the shoe 102. In various embodiments, the adhesive films and strip can be extensive and inelastic, which do not retain the shape of the strip and/or pull tab when elongated within the plane of the film and strip. In other embodiments, the adhesive films and strip are elastic and resilient, and retain and return to their original shape after an elongating pulling force on the strip is released.

Preferably removal of the adhesive strip 114 leaves no adhesive residue or trace of any evidence that the light accessory 100 had been attached to the shoe 102. However, in some embodiments, it may be necessary to clean an adhesive residue from the surface 106 of the shoe 102. The present invention recognizes that high-heeled shoes can be expensive, and owners of these shoes could be reluctant to use the invention were attachment of a lighting accessory to mar, disfigure, damage, deface, or detract from the later appearance of the shoes once the lighting accessory was removed.

Figure 2:
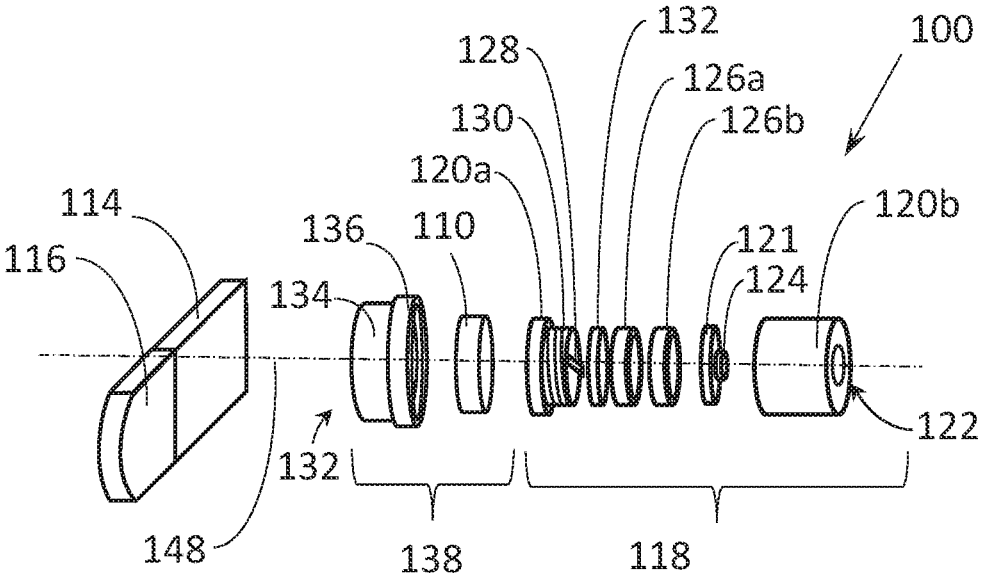
FIG. 2 is a partially disassembled view of the light accessory shown in FIG. 1.

Referring also to FIG. 2, a partially disassembled view of the detachable, retrofitting light accessory 100 of FIG. 1 is shown. The light accessory 100 comprises a light-emitting diode (LED) light assembly 118 and a magnet 110 as previously mentioned. The magnet 110 is mechanically coupled to the LED light assembly 118 through gluing using an adhesive or an epoxy, or a piece of heat-shrink tubing, or otherwise attached, and configured to magnetically engage the ferrous metal shank 108 of the shoe 102 as previously described, magnetically attaching the lighting accessory 100 to the shoe 102. In an embodiment illustrated in FIG. 2, a magnet assembly 138 is provided, including a magnet retainer 132 comprising a cup 134 into which the magnet 110 is inserted. The magnet assembly 138 also includes a rim wall 136 extending from the open edge of the cup 134, the rim wall 136 having an inner diameter configured to engage or accept the outer diameter of a base (first) part **120*a* of the enclosure 120**, as described below.

In an embodiment, the LED light assembly 118 includes an enclosure 120 comprised of a first or base part **120*a* and a second or covering part 120*b*, the two parts threaded or mechanically affixed together to close and form the enclosure. The LED light assembly 118 further includes at least one LED 124, carried by a printed circuit board 121 in one embodiment, see FIG. 2, for example, housed within the enclosure 120 and configured to produce and emit the light. The LED light assembly 118 also includes one or more batteries 126***a*, 126*b*, housed within the enclosure 120 and electrically coupled to the at least one LED 124, such as through the enclosure 120 itself and/or through a metal conductor 128. In an embodiment, the batteries 126 can be a coin-shaped battery. The batteries 126 power the at least one LED 124. Specifically, the metal conductor 130 is used to form and close an electric circuit including the batteries 126 and the at least one LED 124. The LED light assembly 118 further includes a switch 130 housed within or incorporated as part of the enclosure 120, and that is also included in the circuit. In the LED light assembly 118 shown, the switch 130 functions through rotating the first part 120*a* of the enclosure relative to the second part 120*b*, and is thereby, at least one of a rotating-, screw-, or threaded-type, electrically coupling the batteries 126 to each other and to the at least one LED 124 through the enclosure and/or the metal conductor 128, thereby selectable providing continuous lighting 120. Alternatively, in another embodiment, the LED light assembly can include a switch in the form of a removable insulative sheet 132 placed across and against at least one contact surface of one of the batteries 126, which prevents the circuit from being completed during shipment or when lighting 108 is not desired. The insulative sheet 132 is removed to complete the circuit when lighting 108 is desired.

In one embodiment of the light-emitting end, a face surface of the second part 120*b* of the enclosure 120 has at least one aperture 122 for passing light from the LED. In another embodiment, a light transparent or translucent cap or lens can be placed at the open end of the light-emitting portion 120*b*, for passing the LED light.

Figure 3:
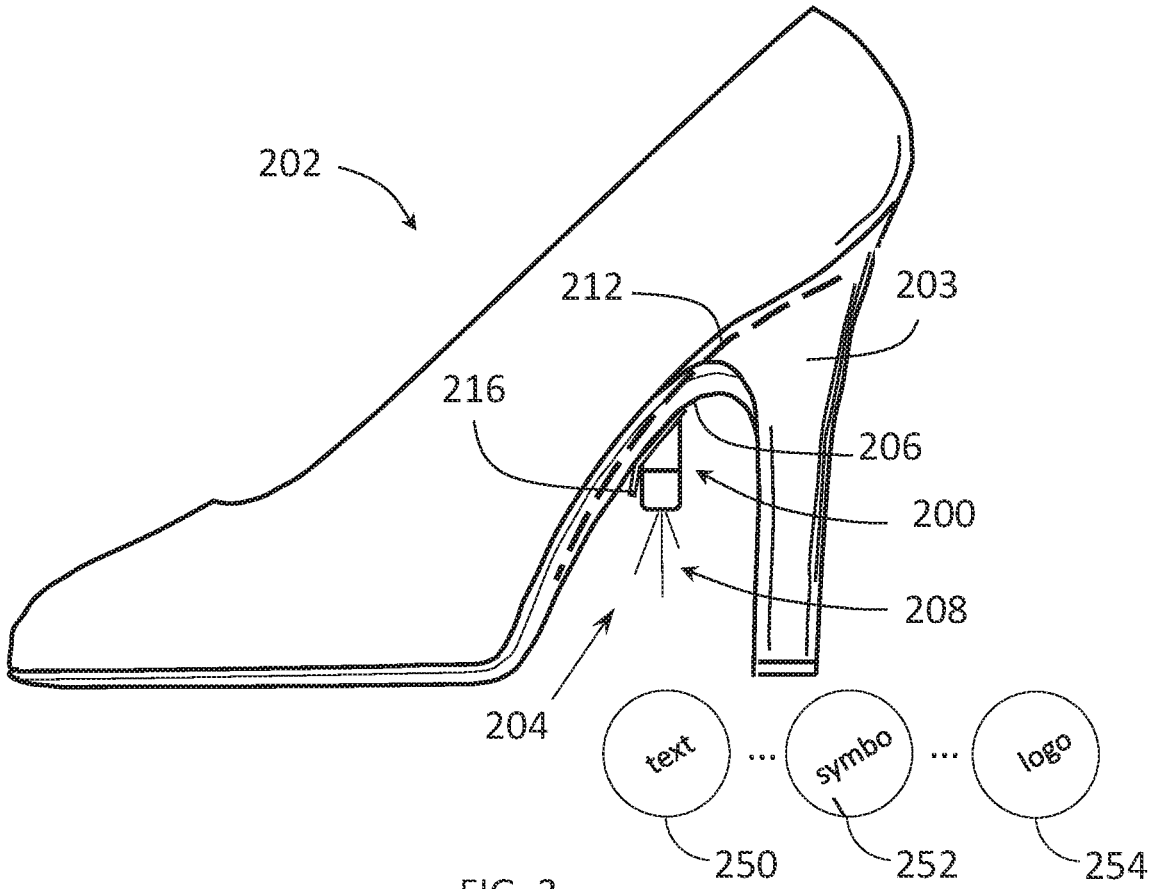
FIG. 3 is a profile view of a second embodiment of a detachable, retrofitting light accessory affixed to a high-heeled shoe.

Referring now to FIG. 3, a second embodiment of a detachable, retrofitting light accessory 200 is shown. As depicted, the light accessory 200 has been affixed to a surface 206 in the open archway 204 of a high-heeled shoe 202, similar to the shoe 102, to add lighting functionality as generally indicated at reference numeral 208.

Figure 4:
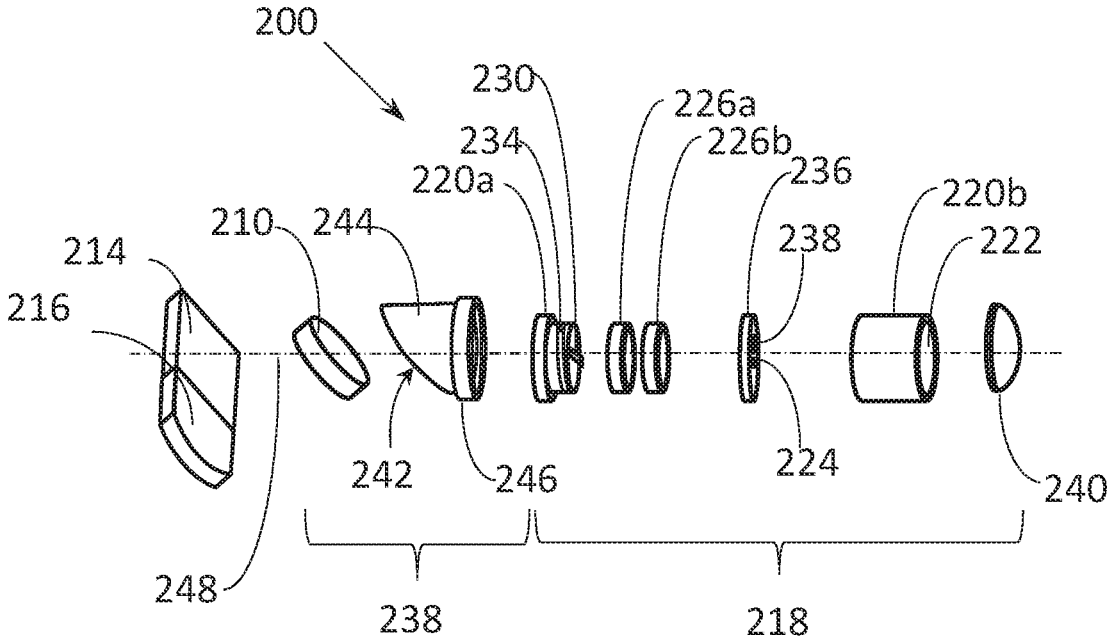
FIG. 4 is a partially disassembled view of the light accessory shown in FIG. 3.
Figure 5:
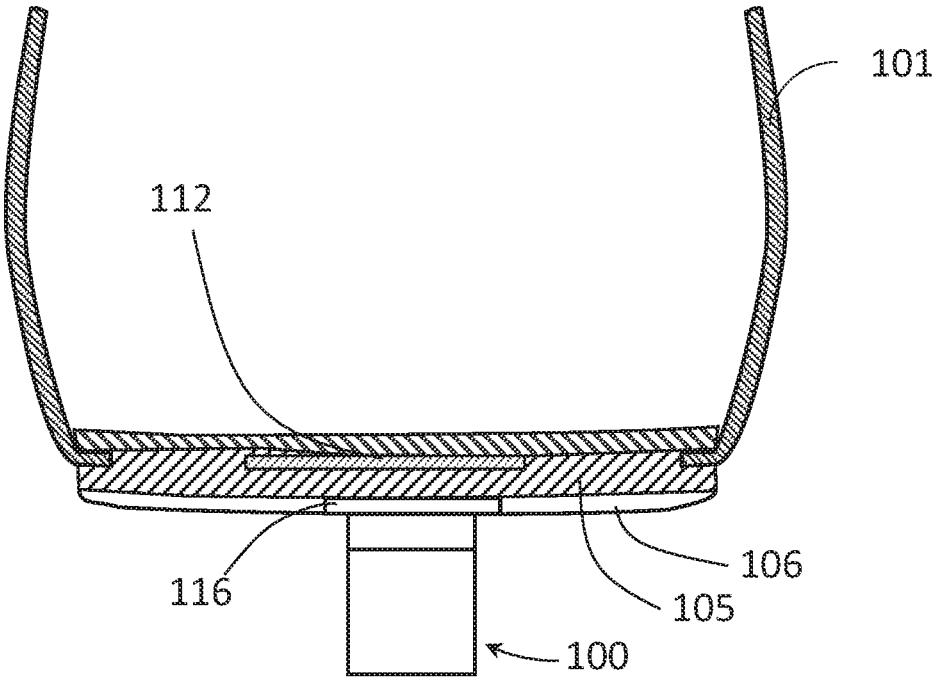
FIG. 5 is a sectional view through the sole of the shoe of FIG. 1, taken along line 5-5.

The light accessory 200 is also magnetically and adhesively attached to the shoe 202 in accordance with the present invention. As shown in FIG. 4, the light accessory 200 also comprises a magnet 210 and an LED light assembly 218. Still referring to FIG. 3, and in an embodiment, the light accessory 200 is magnetically attached through magnetic attraction to and engagement with a ferrous metal insert 212 (shown in hidden line) that has been inserted into the shoe 202 along the shoe sole. Thus, the present invention is adapted through the inclusion of the ferrous metal insert 212 for those high-heeled shoes that lack a ferrous metal shank like, for example, the ferrous metal shank 112 of the shoe 102 shown in FIG. 1. The light accessory 200 includes a doubled-sided adhesive strip 214 with a pull tab 216 for adhesively and removably attaching the lighting accessory 200 to the shoe 202. Again, those of skill in the art will appreciate that while magnetic interaction attaches the lighting accessory 200 to the shoe 202, the adhesive attachment prevents the lighting accessory 200 from slipping relative to the shoe during use.

Figure 7:
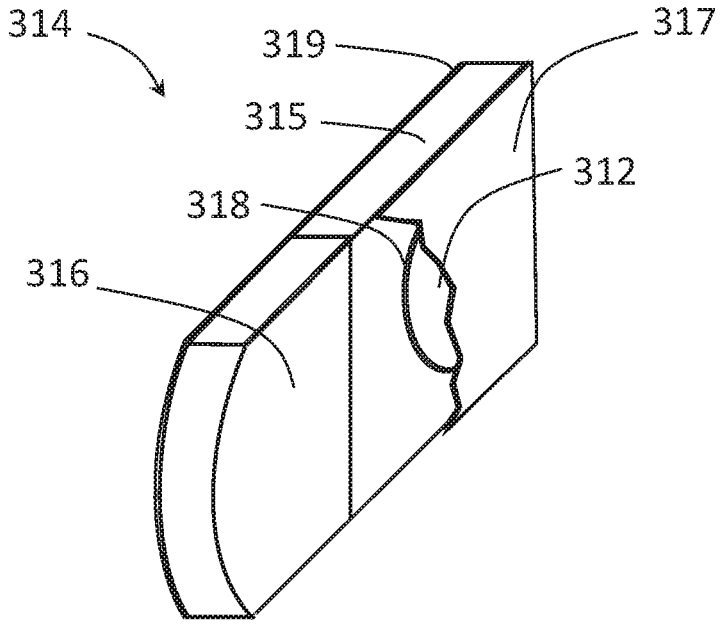
FIG. 7 is a double-sided adhesive strip having an integrated ferrous metal disk.

In another embodiment shown in FIG. 7, a double-sided adhesive strip 314 can include an integrated ferrous metal component, e.g., a ferrous metal disk 318 sized to the magnet. The ferrous metal disk 318 has a size or diameter of at least the size or diameter of the magnet. In some embodiments, the ferrous metal disk can be attached to the first adhesive side or the second adhesive side of the doubled-sided adhesive strip. In some embodiments, the ferrous metal disk can be positioned into an opening 318 or aperture formed into a substrate 315 of a doubled-sided adhesive strip 314, and including a first adhesive layer 317 over a first side of the substrate 315 and a second adhesive layer 319 over a second side of the substrate. The first adhesive side of the double-sided adhesive strip having the integrated ferrous metal component can be adhesively fixed to the outer surface of the sole or heel in the open archway of the shoe as described herein, and the magnet affixed to the LED light assembly can be pressed against the second adhesive side of the double-sided adhesive strip, to both magnetically and adhesively affix the light accessory in the open archway of the shoe.

Referring also to FIG. 4, a partially disassembled view of the detachable, retrofitting light accessory 200 is shown. The light accessory 200 comprises a LED light assembly 218 and a magnet 210 mechanically coupled thereto. The LED light assembly 218 also includes an enclosure 220 comprised of a first or base part 220*a* and a second or covering part 220*b*, the two parts threaded or mechanically affixed together to close and form the enclosure, yet with the ability for the first part to move axially with respect to the second part, see for example, the limited threading 234 on the first part that allows for this axial movement, the use of which will be described in more detail hereinafter. The LED light assembly 218 further includes at least one LED 224, although there are likely more to allow for various lighting functionality as will be appreciated by those of skill in the art, configured to produce and emit the light. In various embodiments, the at least one LED emits light that is at least one of clear, white, red, green, blue, RGB (a discrete combination of red, green, and blue), rainbow (a variable combination of red, green, and blue), pink, ultraviolet, bi-color, tri-color, and multicolor. The at least one LED can be one of organic, electroluminescent, ultra-bright, micro, miniature, standard, surface mount, and thru-hole types. In an embodiment, the at least one LED 224 is carried by a circuit board 236, both of which are housed within the enclosure 220. Further, the circuit board 236 also carries the necessary circuitry 238, e.g., passive and active components, resistors, capacitors, switches, integrated circuits (ICs), etc., preferably surface mount types for purposes of sizing, although one or more components could be thru-hole-types, configured to control the application of battery power to the at least one LED 224, and necessary for the implementation for various lighting functionality including, but not necessarily limited to on/off, flash, rate of application, variable intensity, variable brightness, and change in color functionalities. The LED light assembly 218 also includes one or more batteries 226*a*, 226*b*, housed within the enclosure 220 and electrically coupled to the at least one LED 224, such as through the enclosure 220 itself and/or through a metal conductor 230. The batteries 226 power the at least one LED 124 as provided or controlled by the circuitry 238. The batteries 226 can be a coin-shaped battery. On/off power and operational mode selection is performed and/or selected through axially moving the first part 220*a* of the enclosure relative to the second part 220*b* to actuate a switch includes as part of the circuitry 238. Thus, the switch can be a button-, push button-, or single pole-single throw-type.

The second or covering part 220*b* of the enclosure 220 has an aperture or opening 222 for passing light. Referring to FIG. 4, the LED light assembly 218 further includes a lens 240 positioned across the opening 222 and configured to pass light from the at least one LED 224. In one embodiment, the lens 240 is configured to focus or, alternatively, diffuse the light. The lens 240 can be transparent or translucent, and can be a refracting lens. In another embodiment and as shown in FIG. 3, the lens 240 includes a pattern (not shown due to size), the pattern causing light from the at least one LED to be in the form of text 250, a symbol 252, or a logo 254 when projected on a surface, such as a walking surface. Those of skill in the art will appreciate that if a lighting assembly were not to be vertically oriented, the pattern would have to be distorted to compensate for the light being projected at some angle on the walking surface in order to for the text, symbol, or logo not to be stretched.

Referring to FIGS. 1-4, several similarities, as well as some differences, between the various embodiments are notable. For example, all of the aforementioned embodiments work equally well with all high-heeled shoes, irrespective of whether or not those shoes include a metal shank or not. If a ferrous metal shank 112 is not included as part of the construction of the shoe 102 as illustrated in FIG. 1, a user need only make use of the ferrous metal insert 212 shown in FIG. 3 in practicing the present invention.

Those of skill in the art will notice that all of the embodiments shown have cylindrical construction. This is because the magnets 120, 210, the batteries 126, 226, and the LED light assemblies 118, 218 are all readily available in disk- or cylindrical-shape packages and thus, lend themselves to this type of construction. However, that need not necessarily be the case. Those of skill in the art will be able to vary the shape and/or construction to realize other embodiments, and those variations do not constitute a departure from the present invention.

Referring just to FIGS. 1 and 3, those of skill in the art will also notice a difference in the axial orientation of these cylindrical embodiments when affixed to a shoe. For example, the enclosure 120 of lighting accessory 118 shown in FIG. 1 has a right cylindrical construction, where the longitudinal axis 148 of the cylinder, see FIG. 2, is extending substantially perpendicular to the surface 206 of the archway 204 when the light accessory 100 is magnetically and adhesively attached to the sole 105 of the shoe 102. In FIG. 4, the lighting accessory 200 comprises a magnet assembly 238, including a magnet retainer 242 comprising a cylindrically-shaped pylon cup 242 into which the magnet 210 is inserted. The magnet retainer 242 also includes a rim wall 246 extending from the open edge of the pylon cup 242, the rim wall 246 having an inner diameter configured to engage or accept the outer diameter of a base (first) part 220*a* of the enclosure 220. The attachment end 244 of the pylon cup 242 has a face having an oblique angle, and typically an acute angle, relative to the longitudinal axis 248. The magnet 210 is placed and secured within the first attachment end 244 of the pylon cup 242, and positioned at an angle relative to the longitudinal axis 248 to align parallel with the attaching face of the pylon cup 242, while the opposite end 246 has a face that is substantially perpendicular to the longitudinal axis 248. Referring to FIG. 3, the inclusion of the pylon cup 242 allows the lighting accessory 200 to be substantially vertically oriented in the archway 204 of the shoe 202 when the light accessory 200 is attached to the shoe, the lighting 208 being cast straight down when the lighting accessory 200 is energized. Those of skill in the art can select the oblique or acute angle of the first end 244 of the pylon 242 to adjusting for variations in the surfaces of archways of various shoes so that the longitudinal axis 248 remains vertically oriented.

In an embodiment illustrated in FIG. 2, a magnet assembly 138 is provided, including a magnet retainer 132 comprising a cup 134 into which the magnet 110 is inserted. The magnet assembly 138 also includes a rim wall 136 extending from the open edge of the cup 134, the rim wall 136 having an inner diameter configured to engage or accept the outer diameter of a base (first) part 120*a* of the enclosure 120, as described below.

A number of examples of the present invention have been constructed and in doing so, a number of different combinations of axial button magnets and LED light assemblies were used. Table 1 below lists the exemplary axial button magnets sourced from K&J Magnetics, Inc., located at 18 Appletree Lane, Pipersville, Pa. 18947.

TABLE 1

Exemplary Axial Button Magnets

| Model Number | Diameter (inches/ millimeters) | Thickness (inches/ millimeters) | Pull Force (pounds/ kilograms) |
|---|---|---|---|
| D83 | 0.5/12.7 | 0.1875/4.7625 | 9.14/4.15 |
| D8H2 | 0.5/12.7 | 0.200/5.080 | 9.49/4.30 |
| D83-N52 | 0.5/12.7 | 0.1875/4.7625 | 11.30/5.13 |
| D82-N52 | 0.5/12.7 | 0.125/3.175 | 7.97/3.62 |

Table 2 lists the exemplary LED light assemblies sourced from FlashingBlinkyLights.com, Inc., located at 10810 Cantara Street, Sun Valley, Calif., 91352.

TABLE 2

Exemplary LED Light Assemblies

| Model Number | Diameter (inches/ millimeters) | Color | Flashing Type | Battery ((quantity)/ type) |
|---|---|---|---|---|
| 11565-PK | 0.47/11.94 | Pink | No | (2) CR947 |
| 11565-WT | 0.47/11.94 | White | No | (2) CR947 |
| 11565-RD | 0.47/11.94 | Red | No | (2) CR947 |
| 10900-AUR | 0.62/12.7 | Red/Blue/Green | Change | (2) CR947 |
| 10900-RNBW | 0.47/11.94 | Blue/Red/Green | Rainbow | (2) CR947 |

While various embodiments of a detachable, retrofitting light accessory have been illustrated by the foregoing description and have been described in considerable detail, it is not intended to restrict or in any way limit the scope of the appended claims to such detail. Additional advantages and modifications will become readily apparent to those skilled in the art.

What is claimed is:

1. A detachable light accessory configured for attachment to a high-heeled shoe that has an open archway and a ferrous metal shank in at least one of the sole and the heel of the shoe, the detachable light accessory comprising:

a light emitting diode (LED) light assembly including:

i) an enclosure having an attachment end and a light-emitting end having an aperture;

ii) at least one light emitting diode (LED) housed within the enclosure and configured to emit a light through the light-emitting end of the enclosure; and iii) at least one battery housed within the enclosure, for providing electrical power to the at least one LED;

a magnet affixed to the attachment end of the LED light assembly and configured to magnetically engage the ferrous metal shank in the archway of the shoe; and a double-sided adhesive strip that includes a first adhesive side and a second adhesive side, and is configured for placement between the magnet and an outer surface in the open archway of the shoe, to attach the first adhesive side adhesively and detachably to the magnet, and the second adhesive side to the outer surface in the open archway of the shoe, thereby magnetically and adhesively attaching the detachable light accessory in the open archway of the shoe.

2. The light accessory of claim 1, further including a means for connecting electrically the at least one LED selectively to the at least one battery, to power the at least one LED.

3. The light accessory of claim 2, wherein the means for connecting electrically is selected from the group consisting of a switch integrated into the enclosure that electrically couples the at least one LED and the at least one battery, an insulating sheet, that can be placed between two components selected from among the means for connecting electrically, the at least one LED, and a combination thereof.

4. The light accessory of claim 3, wherein the switch is configured for switch-selectable continuous or intermittent lighting.

5. The lighting accessory of claim 3, wherein the switch is a switch type selected from the group consisting of rotating-, screw-, threaded-, button-, push button-, and single pole-single throw-types.

6. The light accessory of claim 1, wherein the ferrous metal shank is manufactured into at least one of the sole and the heel of the shoe.

7. The light accessory of claim 1, wherein the ferrous metal shank is a ferrous metal insert inserted against the inner sole of the shoe.

8. The light accessory of claim 1, the enclosure having a right cylindrical construction with a longitudinal axis, the longitudinal axis extending perpendicularly to the outer surface in the open archway when the light accessory is magnetically and adhesively attached in the open archway of the shoe.

9. The light accessory of claim 1, wherein the attachment end of the enclosure comprises a cylindrically-shaped pylon having a longitudinal axis, the attachment end of the enclosure comprising an angled face that forms at an oblique angle relative to the longitudinal axis.

10. The light accessory of claim 1, wherein the enclosure includes a metal conductor for forming an electrical circuit that includes the at least one battery and the at least one LED.

11. The light accessory of claim 10, the LED light assembly further including an electronic circuit electrically coupled to the at least one battery and the at least one LED, the electronic circuit being configured to apply a controlled power from the at least one battery to the at least one LED, wherein the controlled power includes at least one of on and off, a flash, rate of application, variable intensity, variable brightness, and a change in color functionalities.

12. The lighting accessory of claim 1, wherein the LED light assembly further including a lens positioned across the aperture and configured to pass light emitted from the at least one LED.

13. The lighting accessory of claim 12, the lens including a pattern, the pattern causing light dispersed from the at least one LED to be in the form of at least one of a text, a symbol, and a logo.

14. The lighting accessory of claim 1, wherein the at least one battery is a coin-shaped battery.

15. The lighting accessory of claim 1, wherein the magnet is a neodymium magnet.

16. The lightning accessory of claim 15, wherein the magnet has a diameter of about 12.7 millimeters (mm), a thickness of about 3.175-5.080 mm, and a pull force of about 3.62-5.13 kilograms (kg).

17. A method of adding decorative lighting into an open archway of a high-heeled shoe, comprising the steps of:

providing a light accessory according to claim 1;

passing the magnet affixed to the LED light assembly over a surface of a sole or a heel in the open archway of a high-heeled shoe, to determine a location of magnetic attraction to a ferrous metal shank in the open archway of the shoe, noting the location of magnetic attraction of the magnet to the ferrous metal shank, removing a protective film from the first adhesive side of the double-sided adhesive strip and applying and adhesively attaching the first adhesive side of the double-sided adhesive strip to the magnet;

removing a protective film from the second side of the double-sided adhesive strip and positioning the second side of the double-sided adhesive strip proximate the location of magnetic attraction, and pressing and adhesively attaching the second side of the double-sided adhesive strip against the outer surface of the sole or the heel at the location of magnetic attraction, thereby both adhesively and magnetically attaching the light accessory to the shoe;

energizing the light accessory; and optionally removing the light accessory.

18. The method of claim 17, wherein the step of passing the magnet comprises determining that the sole or heel in the open archway of the shoe does not have a ferrous metal shank, inserting a ferrous metal insert into the shoe proximate a desired location in the archway for the light accessory; passing again the magnet affixed to the LED light assembly over a surface of a sole or a heel in the open archway of a high-heeled shoe, to determine a location of magnetic attraction to the ferrous metal insert in the open archway of the shoe.

19. The method of claim 18, further including the step of energizing the light accessory by at least one of removing an insulating strip placed between two components selected from among the means for connecting electrically, the at least one LED, and a combination thereof, actuating a switch integrated into the enclosure that electrically couples the at least one LED and the at least one battery.

20. A detachable light accessory configured for attachment to a high-heeled shoe that has an open archway, the detachable light accessory comprising:

a light emitting diode (LED) light assembly including:

i) an enclosure having an attachment end and a light-emitting end having an aperture;

ii) at least one light emitting diode (LED) housed within the enclosure and configured to emit a light through the light-emitting end of the enclosure; and iii) at least one battery housed within the enclosure, for providing electrical power to the at least one LED;

a magnet affixed to the attachment end of the LED light assembly and configured to magnetically engage a ferrous metal shank in the archway of the shoe; and a double-sided adhesive strip including an integrated ferrous metal disk, a first adhesive side and a second adhesive side, and is configured for placement between the magnet and an outer surface in the open archway of the shoe, to attach the first adhesive side adhesively and detachably to the magnet, and the second adhesive side to the outer surface in the open archway of the shoe, thereby magnetically and adhesively attaching the detachable light accessory in the open archway of the shoe.

* * * * *